United States Patent [19]

Gipson et al.

[11] Patent Number: 4,792,170

[45] Date of Patent: Dec. 20, 1988

[54] AIR TANK HANDLE ASSEMBLY

[76] Inventors: Lamar H. Gipson, 12220 SW. 132 Ct.; William P. Batina, 12220 SW. 132 Ct.; Paul H. Vernon, 12220 SW. 132 Ct., all of Miami, Fla. 33186

[21] Appl. No.: 67,558

[22] Filed: Jun. 29, 1987

[51] Int. Cl.[4] ..... B65D 25/28; B65D 63/18

[52] U.S. Cl. ..... 294/31.2; 294/154; 294/169

[58] Field of Search ..... 294/31.2, 27.1, 30, 294/32, 137, 146, 148, 149, 151, 153, 154, 155, 156, 157, 165, 169; 206/446, 317, 407, 413; 248/313; 16/110 R, 114 R

[56] References Cited

U.S. PATENT DOCUMENTS 2,274,973 3/1942 Bryant ..... 294/31.2

3,921,872 11/1975 Buell, Jr. ..... 294/31.2

4,556,245 12/1985 Gruenwald ..... 294/31.2

4,624,495 11/1986 Marsh ..... 294/31.2

*Primary Examiner*—James B. Marbert

*Attorney, Agent, or Firm*—Pettis & McDonald

[57] ABSTRACT

A handle assembly is provided for a generally cylindrical compressed air tank having a longitudinal axis. The assembly includes a substantially annular mounting piece having an outer perimeter and an opening formed therein for receiving an axial section of the air tank. The mounting piece is releasably fastened to the received section of the air tank, and a handle that is disposed entirely within the outer perimeter of the annular portion is attached to the mounting piece to facilitate manipulation of the tank.

19 Claims, 1 Drawing Sheet

AIR TANK HANDLE ASSEMBLY

BACKGROUND OF THE INVENTION

This invention relates to a handle assembly for a compressed air tank, and more particularly to a handle assembly which may be used to manipulate scuba air tanks.

Conventional compressed air tanks such as scuba tanks are often fairly heavy, bulky, and awkward to handle. For example, a standard scuba tank is approximately 26 inches in height, 7 inches in diameter and weighs approximately 35 pounds when empty and 40 pounds when fully charged with compressed air. A person may carry such a tank by cradling it in his arms or alternatively by installing the tank into a conventional scuba backpack and then lifting the backpack and tank onto his back. However, both of these techniques are obviously quite cumbersome, tedious and inconvenient.

Present scuba tanks do not provide any type of adequate hand hold. In order to manipulate the tank by hand the driver, dive shop personnel or boat operator typically must grasp the valve that extends from the top of the tank. This is unsatisfactory because the valve provides a fairly insecure grip, and the tank is likely to slip out of the person's hand and fall to the ground. Inasmuch as most conventional tanks do not provide protection for the valve or the tank wall, this can cause significant damage to either the wall of the tank or the valve. A dropped tank also presents the danger of foot or leg injury.

The lack of a satisfactory grip or handle on conventional tanks also presents difficulties during underwater emergencies. For example, situations may arise when a diver in trouble must hold onto a rescue diver who is attempting to pull the troubled diver to safety. Often the only hand holds that are available in such situations are the hoses that emerge from the tank. However, using hoses in this manner is clearly dangerous and undesirable. If the diver in trouble disrupts or disconnects one of the hoses, an even greater emergency may be caused.

SUMMARY OF THE INVENTION

The present invention addresses and overcomes the above difficulties by providing an improved handle assembly for a generally cylindrical compressed air tank, such as a scuba tank, having a longitudinal axis. In particular, the assembly comprises a substantially annular mounting piece that includes an outer perimeter and an opening formed therein for receiving an axial section of the air tank. There are means for releasably fastening the mounting piece to the received section of the tank, and handle means disposed entirely within the outer perimeter of the mounting piece are attached to the mounting piece to facilitate manipulation of the tank.

In a preferred embodiment the substantially annular mounting piece also has an inner surface disposed about the opening for substantially, conformably engaging the outer surface of the received axial section of the tank. Where the tank includes a convex section proximate the upper end of the tank, the substantially annular portion of the mounting piece may include a substantially concave inner surface for substantially, comformably engaging the convex section of the tank.

The means for releasably fastening may include clamp means that are substantially annularly disposable about the substantially annular mounting piece. Means may also be provided for selectively tightening the clamp means to urge the mounting piece against the tank, whereby the mounting piece is frictionally fastened to the tank. Alternatively, the means for releasably fastening may include resilient means which urge the inner surface of the mounting piece into frictional engagement with the outer surface of the received section of the tank so that the mounting piece is fastened to the tank and which permit the inner surface to selectively expand to remove the mounting piece from the tank.

The handle means may include a gripping portion, and means may be provided for interconnecting the gripping portion with the mounting piece. The gripping portion may also include an interior compartment for storing accessories therein, and means may be provided for selectively opening and closing that compartment.

A substantially annular lip may extend from the substantially annular mounting piece beyond the bottom of the tank. At least a portion of the lip may form the handle means. The lip may include a first lip section attached to the mounting piece, and a second lip section attached to the first section and folded inwardly relative to extend through the first section. Such a lip may define a substantially U-shaped cross section and may include a distal edge that is engagable with the bottom end of the tank. This may form a substantially annular chamber and at least one aperture may be provided though the lip into the chamber. Preferably the lip is integrally attached to the substantially annular mounting piece.

The handle means may be integrally connected to the mounting piece. Typically the mounting piece is formed from of a shock absorbing material.

In order to provide for advantageous manipulation of a compressed air tank, a pair of mounting pieces may be provided proximate the upper and lower ends of the tank, respectively. This enables the tank to be maneuvered, lifted and carried with both hands.

The handle assembly constructed in the above manner provides for a number of additional benefits. The handles enable the tank to be more easily manipulated and eliminate the need for carrying or dragging the tank by its valve. As a result, there is less chance that the tank will be dropped and that its valve or walls will be damaged. Furthermore, the use of a shock absorbing material and the provision of a mounting piece that includes a lip extending below the bottom end of the tank further reduces the chance that the tank will be damaged. If it is dropped, the shock absorbing lip is likely to engage the ground first, thereby softening the impact on the tank.

The handle assembly of this invention also provides for a hand hold that facilitates undersea rescue. At the same time, the use of the lip portion as a handle reduces the risk of the lower portion of the tank becoming snagged on underwater debris. Likewise, because the handle extends radially no further than the outer perimeter of the mounting piece the risk of snagging is reduced considerably. The compartmented gripping portion in the handles enables the diver to store accessories such as shark repellent, underwater flashlights, maps or spare straps conveniently.

The invention accordingly comprises an article of manufacture possessing the features, properties and the relation of elements which will be exemplified in the article hereinafter described, and the scope of the invention will be indicated to the claims.

BRIEF DESCRIPTION OF THE DRAWINGS

Other objects, features and advantages will occur from the following description of a preferred embodiment and the accompanying drawings in which.

DETAILED DESCRIPTION

Figure 1:
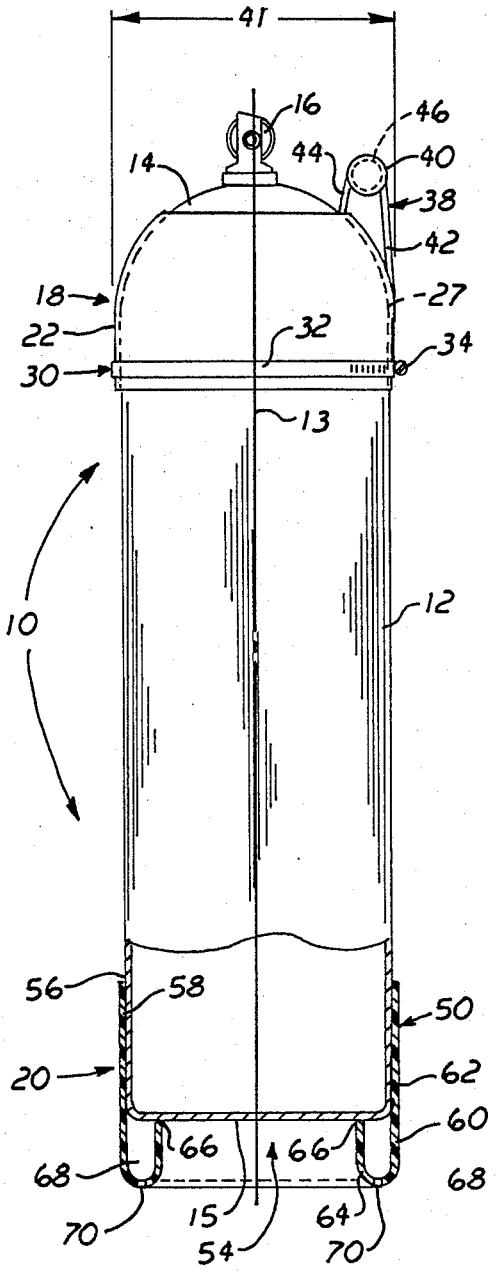
FIG. 1 is an elevational, partly sectional view of a preferred handle assembly according to this invention.

There is shown in FIG. 1 a handle assembly, generally indicated as 10, that is removably attached to a conventional, generally cylindrical compressed air tank 12. Tank 12 is the type that is employed in scuba diving or similar applications. Alternatively, the handle assembly may be employed with compressed air tanks such as are used in hospitals and emergency vehicles. The tank specifically includes a longitudinal axis 13, a convex upper end 14 and a substantially flat bottom 15. Conventional valve 16 emerges from upper end 14. Valve 16 is adapted for receiving the first stage of a scuba diving regulator in a conventional manner.

Figure 2:
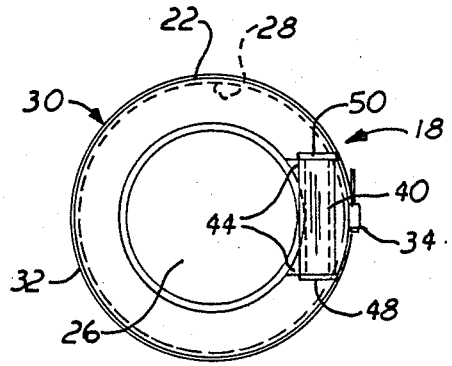
FIG. 2 is a top plan view of a preferred first upper part of the handle assembly.

More particularly, handle assembly 10 includes upper and lower parts 18 and 20, respectively. Upper part 18, shown alone in FIG. 2, includes an upper mounting piece 22 having a substantially annular shape. A central opening 26 is formed through mounting piece 22. An upper axial section 27 of tank 12, which section includes a portion of convex upper end 14, is received through opening 26 in the manner shown in FIG. 1, and mounting piece 22 includes an inner surface 28, shown in FIG. 2, that substantially, conformably engages the received axial section 27 of tank 12. More specifically, inner surface 28 of mounting piece 22 includes a concave portion that substantially engages section 27 of convex upper end 14 of tank 12. The uppermost end of convex tank portion 14 as well as valve 16 emerge from opening 26 and extend above mounting piece 22.

Means such as a clamp 30 are provided for releasably fastening mounting piece 22 to the received section 27 of tank 12. Clamp 30 typically comprises a conventional aluminum hose clamp or similar fastener. The clamp includes a strap portion 32 that is wrapped about mounting piece 22. An adjusting screw 34 is selectively tightened in a conventional manner to urge mounting piece 22 against the outer wall of tank 12 so that the mounting piece is frictionally fastened to the tank.

A handle means 38 is attached to mounting piece 22 to facilitate manipulation of the upper end of tank 12. Preferably, handle 38 is integrally attached to mounting piece 22, although alternatively it may be connected to the mounting piece by epoxy, or other suitable fastening means. Typically, both mounting piece 22 and handle 38 are formed from injection molded ABS plastic or other synthetic resin. The material is chosen to provide part 18 with strength and durability as well as to provide shock absorbing characteristics. Handle 38 includes a generally cylindrical gripping section 40 that is interconnected to mounting piece 22 by a pair of forward stanchions 42 and a pair of rearward stanchions 44. Handle 38 is disposed entirely within the outer perimeter 41 of piece 22. This reduces the likelihood that the handle 38 will snag on underwater objects. Gripping portion 40 includes a central axial compartment 46 that is particularly useful for accommodating maps, flashlights, spare straps, knives and other diving equipment. Such material may be held within compartment 46 by end caps 48 and 50 that are removably attached to respective ends of gripping portion 40.

Figure 3:
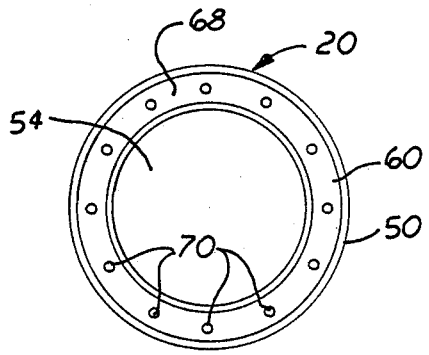
FIG. 3 is a top plan view of a preferred second lower part of the handle assembly.

Lower part 20 of handle assembly 10, shown alone in FIG. 3, and in section in FIG. 1, includes a lower mounting piece 50 having a substantially annular shape. Mounting piece 50 includes a central opening 54 that receives an axial section 56 of tank 12 proximate the bottom end of the tank. Inner surface 58 of mounting piece 50 conformably engages the outer surface of tank section 56. A substantially annular lip 60 is integrally attached to mounting piece 50 and extends therefrom beyond bottom end 15 of tank 12. Lip 60 includes a first lip section 62 and a second lip section 64 that is attached to and folds inwardly from first lip section 62. As shown in FIG. 1 this provides lip 60 with a substantially U-shaped cross section. The distal end 66 of second lip section 64 engages bottom surface 15 of tank 12. As a result, an annular chamber 68 is defined by lip 60. As shown in FIGS. 1 and 3, a plurality of apertures 70 are provided through the bottom of lip 60. These apertures drain water that may collect within chamber 68 during an underwater dive.

Similar to upper part 18, lower part 20 is typically composed of a rugged shock-absorbent material such as ABS plastic. This material is also somewhat resilient so that lower mounting piece 50 may be releasably fastened to lower section 56 of tank 12. For example, in its normal relaxed state the inner diameter of mounting piece 50 is slightly smaller than the outer diameter of tank 12. By expanding the reslient mounting piece 50, tank 12 may be inserted through opening 54 until the bottom 15 of the tank engages lip edge 66. The resilient material in mounting piece 50 urges inner surface 58 into frictional engagement with the outer surface of received tank section 56. As a result, the mounting piece is releasably fastened to tank 12. Mounting piece 50 may then be removed simply by diametrically expanding the lower mounting piece, disengaging inner surface 58 from the outer wall of tank section 56, and sliding mounting piece 50 off the tank.

Lip 60 forms the lower handle of assembly 10. As a result, a pair of handles are provided by lip 60 and handle 38, so that tank 12 may be conveniently manipulated with two hands. In operation, parts 18 and 20 are attached as shown in FIG. 1 and described above. Gripping portion 40 of handle 38 is grasped in one hand and lip 60 is grasped in the other hand. The tank may then be lifted, carried or maneuvered without having to grasp the tank valve or cradle the tank in one's arms.

The handle assembly of this invention provides a number of additional advantages. For example, if the tank is accidently dropped, lip 60 is likely to engage the ground first and protect the bottom 15 of tank 12 from damage. The liklihood of damage to the tank is also reduced by empty annular chamber 68 through lip 60. This chamber assists the shock absorbent material of the lip 60 in cushioning the tank against falls. Handle 38 provides a convenient hand hold for a diver requiring assistance or being pulled to safety. Because neither handle 38 nor lip 60 extends radially beyond the perimeter of its respective mounting piece the handles resist snagging on underwater vegetation and other objects. Similarly, by making the handle on the lower part 20 a lip 60, rather than a separate handle component such as upper handle 38, the handle assembly is less likely to snag on underwater obstacles.

It will thus be seen that the objects set forth above, among those made apparent from the preceding description are efficiently obtained, and, since certain changes made be made in the above article without departing from the scope of the invention, it is intended that all matter contained in the above description or shown in the accompanying drawings shall be interpreted as illustrative and not in a limiting sense.

It is also understood that the following claims are intended to cover all of the generic and specific features of the invention herein described, and all statements of the scope of the invention which, as a matter of language, might be said of fall therebetween.

What is claimed is:

1. A handle assembly for a generally cylindrical compressed air tank having a longitudinal axis, said assembly comprising:

a substantially annular mounting piece that includes an outer perimeter and a central opening formed therein for receiving an axial section of said air tank, means for releasably fastening said mounting piece to the received section of said air tank, and handle means attached to said mounting place and disposed entirely within the outer perimeter of said mounting piece to facilitate manipulation of said air tank.

2. The assembly of claim 1 in which said substantially annular portion further comprises an inner surface disposed about said opening for substantially, conformably engaging the outer surface of the received axial section of said air tank.

3. The assembly of claim 1 wherein said tank includes a convex region proximate the upper end of said tank and wherein said substantially annular mounting piece includes a substantially concave inner surface for substantially, comformably engaging said convex region of said air tank.

4. The assembly of claim 1 in which said means for releasably fastening includes clamp means that are substantially annularly disposable about said substantially annular mounting piece and means for selectively tightening said clamp means to urge said mounting piece against said tank, whereby said mounting piece is frictionally fastened to said tank.

5. The assembly of claim 1 wherein said handle means includes a gripping portion and means interconnecting said gripping portion with said mounting piece.

6. The assembly of claim 5 wherein said gripping means includes an interior compartment for storing accessories therein.

7. The assembly of claim 6 further including means for selectively opening and closing said compartment.

8. The assembly of claim 1 further including a substantially annular lip that extends from said substantially annular mounting piece beyond a bottom end of the tank.

9. The assembly of claim 8 wherein said lip includes a first lip section that is attached to said substantially annular mounting piece and a second lip section that is attached to and folded inwardly relative to said first lip section.

10. The assembly of claim 9 wherein said lip defines a substantially U-shaped cross section.

11. The assembly of claim 10 wherein said second lip section includes a distal edge that is engageable with the bottom end of said tank such that said lip forms an annular chamber adjacent the bottom of the tank.

12. The assembly of claim 8 wherein said lip is integrally attached to said substantially annular section.

13. The assembly of claim 8 wherein said lip forms said handle means.

14. The assembly of claim 1 wherein said mounting piece is formed from a shock-absorbing material.

15. The assembly of claim 2 wherein said means for releasably fastening include resilient means which urge said inner surface into frictional engagement with said outer surface of said received section of the tank such that said mounting piece is fastened to said tank and which permit said inner surface to be selectively expanded to remove said mounting piece from said tank.

16. The assembly of claim 1 wherein said handle means are integrally connected to said mounting piece.

17. A handle assembly for a generally cylindrical compressed air tank having a longitudinal axis and a convex region proximate an upper end of the tank and an opposite substantially flat lower end, said assembly comprising:

an upper substantially annular first mounting piece having an opening formed therein for receiving a first axial section of said tank proximate the upper end of said tank and a substantially concave inner surface for substantially conformably engaging said convex region of said tank, a lower substantially annular mounting piece having an opening formed therein for receiving a second axial section of said tank proximate the lower end of said tank and an inner surface disposed about said opening for substantially, conformably engaging the outer surface of the received second axial section of said tank, means for releasably fastening said first and second mounting pieces to respective received axial sections of said tank, and first and second handle means attached, respectively, to said first and second mounting pieces to facilitate manipulation of said tank.

18. A handle assembly for a generally cylindrical compressed air tank having a longitudinally axis, said assembly comprising:

a substantially annular mounting piece that includes an outer perimeter and a central opening formed therein for receiving an axial section of said air tank, means for releasably fastening said mounting piece to the received section of said air tank, handle means attached to said mounting piece and disposed entirely within the outer perimeter of said annular portion of said mounting piece to facilitate manipulation of said air tank, and a substantially annular lip that extends from said substantially annular mounting piece beyond a bottom of the tank, said lip defining a substantially U-shaped cross section, and including a first lip section that is attached to said substantially annular mounting piece and a second lip section that is attached to and folded inwardly relative to said first lip section, said second lip section including a distal edge that is engagable with the bottom end of said tank such that said lip forms an annular chamber adjacent the bottom of the tank.

19. The assembly of claim 18 wherein said lip includes at least one aperture for draining water from said annular chamber.

* * * * *